US010934831B2

(12) United States Patent
Papouras et al.

(10) Patent No.: US 10,934,831 B2
(45) Date of Patent: Mar. 2, 2021

(54) DOWNHOLE DRILLING USING A NETWORK OF DRILLING RIGS

(71) Applicant: NABORS DRILLING TECHNOLOGIES USA, INC., Houston, TX (US)

(72) Inventors: Christopher Papouras, Houston, TX (US); Srikanth Valleru, Spring, TX (US); Namitha Vinay, Cypress, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 124 days.

(21) Appl. No.: 16/374,443

(22) Filed: Apr. 3, 2019

(65) Prior Publication Data

US 2020/0318471 A1 Oct. 8, 2020

(51) Int. Cl.

| | |
|---|---|
| ***E21B 44/00*** | (2006.01) |
| ***E21B 47/12*** | (2012.01) |
| ***E21B 7/04*** | (2006.01) |
| ***E21B 45/00*** | (2006.01) |

(52) U.S. Cl.

CPC ..... *E21B 44/00* (2013.01); *E21B 7/04* (2013.01); *E21B 44/005* (2013.01); *E21B 45/00* (2013.01); *E21B 47/12* (2013.01); *E21B 2200/20* (2020.05); *E21B 2200/22* (2020.05)

(58) Field of Classification Search

CPC ..... E21B 44/00; E21B 45/00; E21B 2200/20; E21B 2200/22

See application file for complete search history.

(56) References Cited

U.S. PATENT DOCUMENTS 8,210,283 B1 * 7/2012 Benson ..... E21B 47/10 175/61

2019/0330968 A1 10/2019 Boone et al.

* cited by examiner

*Primary Examiner* — Tara Schimpf

(74) *Attorney, Agent, or Firm* — Haynes and Boone, LLP

(57) ABSTRACT

A method of drilling a first wellbore in an oilfield where an offset wellbore has been formed, the method including executing, using a computing system, at least a portion of a first set of instructions based on a well plan relating to the first wellbore; receiving, by the computing system, after the execution of at least the portion of the first set of instructions, offset drilling data associated with the drilling of the offset wellbore; generating, using the computing system, a second set of instructions based on the offset drilling data; wherein the second set of instructions is based on the well plan relating to the first wellbore; and wherein the second set of instructions is different from the first set of instructions; requesting confirmation to execute the second set of instructions; and executing the second set of instructions after receipt of confirmation to execute the second set of instructions.

10 Claims, 9 Drawing Sheets

DOWNHOLE DRILLING USING A NETWORK OF DRILLING RIGS

BACKGROUND

At the outset of a drilling operation, drillers typically establish a drilling plan that includes a target location and a drilling path, or well plan, to the target location. Once drilling commences, the bottom hole assembly ("BHA") is directed or "steered" from a vertical drilling path in any number of directions, to follow the proposed well plan. For example, to recover an underground hydrocarbon deposit, a well plan might include a vertical well to a point above the reservoir, then a directional or horizontal well that penetrates the deposit. The drilling operator may then steer the BHA, including the bit, through both the vertical and horizontal aspects in accordance with the plan.

Often, the drilling operator is drilling the wellbore in an oilfield in which other offset wellbores are being drilled or have been drilled. Data concerning the offset wellbore(s) is often helpful or relevant to how the drilling operator should steer the BHA. When the data concerning the offset wellbore (s) is not shared with the drilling operator, however, the drilling operator cannot consider the offset wellbore when deciding how to proceed. As a result, the steering of the BHA may not be optimum and the BHA can be prematurely tripped out, the tortuosity of the actual well path can be increased, a slide segment can be performed in a formation type in which a slide segment should not be performed, and the actual drilling path could differ significantly from the well plan, etc. Thus, a method and apparatus for sharing data between a network of drilling rigs and automatically altering proposed drilling instructions is needed.

SUMMARY

A method of drilling a first wellbore in an oilfield in which an offset wellbore has been formed is disclosed. The method includes executing, using a computing system, at least a portion of a first set of instructions based on a well plan for the first wellbore; receiving, by the computing system, after the execution of at least the portion of the first set of instructions, offset drilling data associated with the drilling of the offset wellbore; generating, using the computing system, a second set of instructions based on the offset drilling data; wherein the second set of instructions is based on the well plan for the first wellbore; and wherein the second set of instructions is different from the first set of instructions; requesting confirmation to execute the second set of instructions; and executing the second set of instructions after receipt of confirmation to execute the second set of instructions. In one embodiment, executing at least a portion of the first set of instructions includes drilling the first wellbore using a first bottom hole assembly (BHA); wherein the method further includes receiving, by the computing system, drilling data from the first BHA; and wherein generating, using the computing system, the second set of instructions is further based on the drilling data from the first BHA. In one embodiment, the drilling data from the first BHA includes a first motor output; wherein the first set of instructions is based on a predicted motor output; wherein the method further includes comparing, using the computing system, the predicted motor output to the first motor output; and wherein generating the second set of instructions is further based on the comparison of the predicted motor output to the first motor output. In one embodiment, the drilling data from the first BHA includes a first motor output; wherein the offset drilling data includes a second motor output associated with a second BHA drilling the offset wellbore; wherein the method further includes comparing, using the computing system, the first motor output to the second motor output; and wherein generating the second set of instructions is further based on the comparison of the first motor output to the second motor output. In one embodiment, the offset drilling data includes data associated with tripping out a second BHA that extended within the offset wellbore in response to a first drilling event; and wherein the second set of instructions is generated to delay or avoid a second drilling event that is identical to the first drilling event. In one embodiment, the offset drilling data includes data associated with tripping out a second BHA that extended within the offset wellbore in response to a first drilling event; and wherein the second set of instructions is generated to delay or avoid tripping out the first BHA in response to a second drilling event that is identical to the first drilling event. In one embodiment, executing at least a portion of the first set of instructions, receiving the offset drilling data, generating the second set of instructions, requesting confirmation to execute the second set of instructions, and executing the second set of instructions occur after a first stand of drill pipe is coupled to the first BHA and before a second consecutive stand of drill pipe is coupled to the first BHA. In one embodiment, the method also includes determining whether the second set of instructions comply with a plurality of operating parameters; wherein requesting confirmation to execute the second set of instructions is in response to the second set of instructions not complying with the plurality of operating parameters. In one embodiment, receiving the offset drilling data occurs in real-time. In one embodiment, the plurality of operating parameters includes a maximum dogleg severity and/or a maximum slide distance.

An apparatus for drilling a first wellbore in an oilfield in which an offset wellbore has been formed is disclosed. The apparatus includes a user interface; and a controller communicatively connected to a first bottom hole assembly ("BHA") and configured to: execute, using the first BHA, at least a portion of a first set of instructions based on a well plan relating to the first wellbore; receive, after the execution of at least the portion of the first set of instructions, offset drilling data associated with the drilling of the offset wellbore; generate a second set of instructions based on the offset drilling data; wherein the second set of instructions is based on the well plan relating to the first wellbore; request, using the user interface, confirmation to execute the second set of instructions; and execute, using the first BHA, the second set of instructions after receipt of confirmation to execute the second set of instructions. In one embodiment, the controller is further configured to receive drilling data from the first BHA; and wherein the controller is configured to generate the second set of instructions based on the drilling data from the first BHA. In one embodiment, the drilling data from the first BHA includes a first motor output; wherein the first set of instructions is based on a predicted motor output; wherein the controller is further configured to compare the predicted motor output to the first motor output; and wherein the controller is configured to generate the second set of instructions based on the comparison of the predicted motor output to the first motor output. In one embodiment, the drilling data from the first BHA includes a first motor output; wherein the offset drilling data includes a second motor output associated with a second BHA drilling the offset wellbore; wherein the controller is further configured to compare the first motor output to the second motor output;

and wherein the controller is configured to generate the second set of instructions based on the comparison of the first motor output to the second motor output. In one embodiment, the offset drilling data includes data associated with tripping out a second BHA that extended within the offset wellbore in response to a first drilling event; and wherein the second set of instructions is generated to delay or avoid a second drilling event that is identical to the first drilling event. In one embodiment, the offset drilling data includes data associated with tripping out a second BHA that extended within the offset wellbore in response to a first drilling event; and wherein the second set of instructions is generated to delay or avoid tripping out the first BHA in response to a second drilling event that is identical to the first drilling event. In one embodiment, the controller is further configured to, after a first stand of drill pipe is coupled to the first BHA and before a second consecutive stand of drill pipe is coupled to the first BHA, execute at least a portion of the first set of instructions, receive the offset drilling data, calculate the second set of instructions, request confirmation to execute the second set of instructions, and execute the second set of instructions. In one embodiment, the controller is further configured to determine whether the second set of instructions comply with a plurality of operating parameters; and wherein the controller is configured to request confirmation to execute the second set of instructions is in response to the second set of instructions not complying with the plurality of operating parameters. In one embodiment, the controller is further configured to receive the offset drilling data in real-time.

A method of drilling a first wellbore in an oilfield in which an offset wellbore has been formed is disclosed. The method includes displaying a first screen on graphical user interface ("GUI") of a computing device; wherein the first screen includes drilling data associated with the first wellbore and a first set of instructions based on a well plan for the first wellbore; and wherein the first set of instructions is based on historical drilling data associated with the drilling of the offset wellbore; and displaying, after displaying the first screen, a second screen on the GUI that includes a request to implement a second set of instructions that is based on the well plan for the first wellbore; wherein the request to implement the second set of instructions is in response to receipt of updated drilling data associated with the drilling of the offset wellbore; wherein the receipt of the updated drilling data occurs after generation of the well plan for the first well plan; wherein the second set of instructions is different from the first set of instructions; and wherein the second set of instructions is based on the updated drilling data and the drilling data associated with the first wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
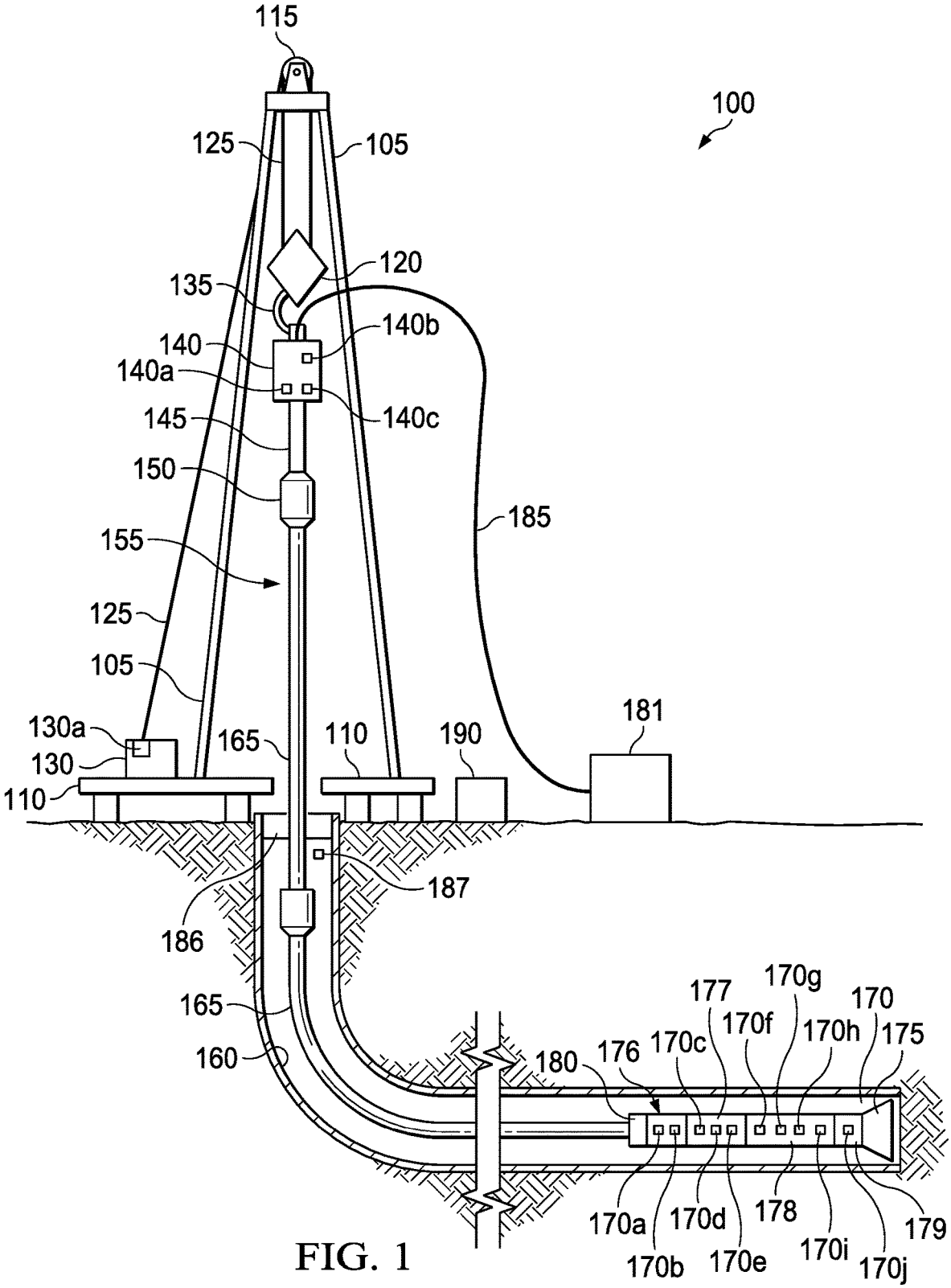
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and methods disclosed herein automate the alteration and execution of drilling instructions using data received from offset drilling rigs, resulting in increased efficiency and speed during drilling compared to conventional systems that do not consider real-time data from offset drilling rigs. Prior to drilling, a target location is typically identified, and an optimal wellbore profile or planned path is established. Such target well plans are generally based upon the most efficient or effective path to the target location or locations and are based on the data available at the time. As drilling proceeds, the apparatus and methods disclosed herein determine the position of the BHA, receive real-time data from offset drilling rigs, create instructions based on the position of the BHA and the real-time data from the offset drilling rigs, and execute the instructions. Thus, the apparatus and methods disclosed herein automate the receipt of data from a network of offset drilling rigs and modification of drilling instructions based on the data from the network of offset drilling rigs. Generally, real-time data includes data received via a standard static survey, continuous data received from a BHA between two consecutive standard static surveys, and data associated with the drilling operations before, during, and after drilling.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Generally, the apparatus 100 monitors, in real-time, drilling operations relating to a wellbore, receives data in real-time or close to real-time from a network of offset drilling rigs, and creates and/or modifies drilling instructions based on the real-time data. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present invention before a further wellbore being drilled achieves that depth. In some embodiments, the apparatus 100 recommends options to correct deviations from a planned well program for the wellbore and interprets drilling data while referencing the data from the network of offset drilling rigs to avoid drilling events similar to those encountered in the network of offset drilling rigs.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a controller to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165 and a BHA 170, which includes a drill bit 175. The BHA 170 may include one or more measurement-while-drilling ("MWD") or wireline conveyed instruments 176, flexible connections 177, optional motors 178, adjustment mechanisms 179 for push-the-bit drilling or bent housing and bent subs for point-the-bit drilling, a controller 180, stabilizers, and/or drill collars, among other components. One or more pumps 181 may deliver drilling fluid to the drill string 155 through a hose or other conduit 185, which may be connected to the top drive 140.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the controller 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor 170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on).

The apparatus 100 may additionally or alternatively include a shock/vibration sensor 170*b* that is configured for detecting shock and/or vibration in the BHA 170. The apparatus 100 may additionally or alternatively include a mud motor delta pressure (AP) sensor 170*c* that is configured to detect a pressure differential value or range across the one or more optional motors 178 of the BHA 170. In some embodiments, the mud motor AP may be alternatively or additionally calculated, detected, or otherwise determined at the surface, such as by calculating the difference between the surface standpipe pressure just off-bottom and pressure once the bit touches bottom and starts drilling and experiencing torque. The one or more motors 178 may each be or include a positive displacement drilling motor that uses hydraulic power of the drilling fluid to drive the bit 175, also known as a mud motor. One or more torque sensors, such as a bit torque sensor, may also be included in the BHA 170 for sending data to a controller 190 that is indicative of the torque applied to the bit 175.

The apparatus 100 may additionally or alternatively include a toolface sensor 170*e* configured to estimate or detect the current toolface orientation or toolface angle. The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*f* integral to the BHA 170 and configured to detect WOB at or near the BHA 170. The apparatus 100 may additionally or alternatively include an inclination sensor 170*g* integral to the BHA 170 and configured to detect inclination at or near the BHA 170. The apparatus 100 may additionally or alternatively include an azimuth sensor 170*h* integral to the BHA 170 and configured to detect azimuth at or near the BHA 170. The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145. In some embodiments, the BHA 170 also includes another directional sensor 170*i* (e.g., azimuth, inclination, toolface, combination thereof, etc.) that is spaced along the BHA 170 from one or another directional sensor (e.g., the inclination sensor 170*g*, the azimuth sensor 170*h*). For example, and in some embodiments, the sensor 170*i* is positioned in the MWD 176 and the another directional sensor is positioned in the adjustment mechanism 179, with a known distance between them, for example 20 feet, configured to estimate or detect the current toolface orientation or toolface angle. The sensors 170*a*-170*j* are not limited to the arrangement illustrated in FIG. 1 and may be spaced along the BHA 170 in a variety of configurations.

The top drive 140, the draw works 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*f*. The WOB sensor 140*f* may be configured to detect a WOB value or range, where such detection may be performed at the top drive 140, the draw works 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

In some embodiments, the controller 180 is configured to control or assist in the control of one or more components of the apparatus 100. For example, the controller 180 may be configured to transmit operational control signals to the controller 190, the draw works 130, the top drive 140, other components of the BHA 170 such as the adjustment mechanism 179, and/or the pump 181. The controller 180 may be a stand-alone component that forms a portion of the BHA 170 or be integrated in the adjustment mechanism 179 or another sensor that forms a portion of the BHA 170. The controller 180 may be configured to transmit the operational control signals or instructions to the draw works 130, the top drive 140, other components of the BHA 170, and/or the pump 181 via wired or wireless transmission means which, for the sake of clarity, are not depicted in FIG. 1.

The apparatus 100 also includes the controller 190, which is or forms a portion of a computing system, configured to control or assist in the control of one or more components of the apparatus 100. For example, the controller 190 may be configured to transmit operational control signals to the draw works 130, the top drive 140, the BHA 170 and/or the pump 181. The controller 190 may be a stand-alone component installed near the mast 105 and/or other components of the apparatus 100. In an example embodiment, the controller 190 includes one or more systems located in a control room proximate the mast 105, such as the general-purpose shelter often referred to as the "doghouse" serving as a combination tool shed, office, communications center, and general meeting place. The controller 190 may be configured to transmit the operational control signals to the draw works 130, the top drive 140, the BHA 170, and/or the pump 181 via wired or wireless transmission means which, for the sake of clarity, are not depicted in FIG. 1.

In some embodiments, the controller 190 is not operably coupled to the top drive 140, but instead may include other drive systems, such as a power swivel, a rotary table, a coiled tubing unit, a downhole motor, and/or a conventional rotary rig, among others.

In some embodiments, the controller 190 controls the flow rate and/or pressure of the output of the mud pump 181.

In some embodiments, the controller 190 controls the feed-out and/or feed-in of the drilling line 125, rotational control of the draw works (in v. out) to control the height or position of the hook 135 and may also control the rate the hook 135 ascends or descends. However, example embodiments within the scope of the present disclosure include those in which the draw-works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string 155.

Generally, the apparatus 100 also includes a hook position sensor that is configured to detect the vertical position of the hook 135, the top drive 140, and/or the travelling block 120. The hook position sensor may be coupled to, or be included in, the top drive 140, the draw works 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor is configured to detect the vertical distance the drill string 155 is raised and lowered, relative to the crown block 115. In some embodiments, the hook position sensor is a draw works encoder, which may be the ROP sensor 130*a*. In some embodiments, the apparatus 100 also includes a rotary RPM sensor that is configured to detect the rotary RPM of the drill string 155. This may be measured at the top drive 140 or elsewhere, such as at surface portion of the drill string 155. In some embodiments, the apparatus 100 also includes a quill position sensor that is configured to detect a value or range of the rotational position of the quill 145, such as relative to true north or another stationary reference. In some embodiments, the apparatus 100 also includes a pump pressure sensor that is configured to detect the pressure of mud or fluid that powers the BHA 170 at the surface or near the surface. In some embodiments, the apparatus also includes a MSE sensor that is configured to detect the MSE representing the amount of energy required per unit volume of drilled rock. In some embodiments, the MSE is not directly sensed, but is calculated based on sensed data at the controller 190 or other controller. In some embodiments, the apparatus 100 also includes a bit depth sensor that detects the depth of the bit 175.

Figure 2:
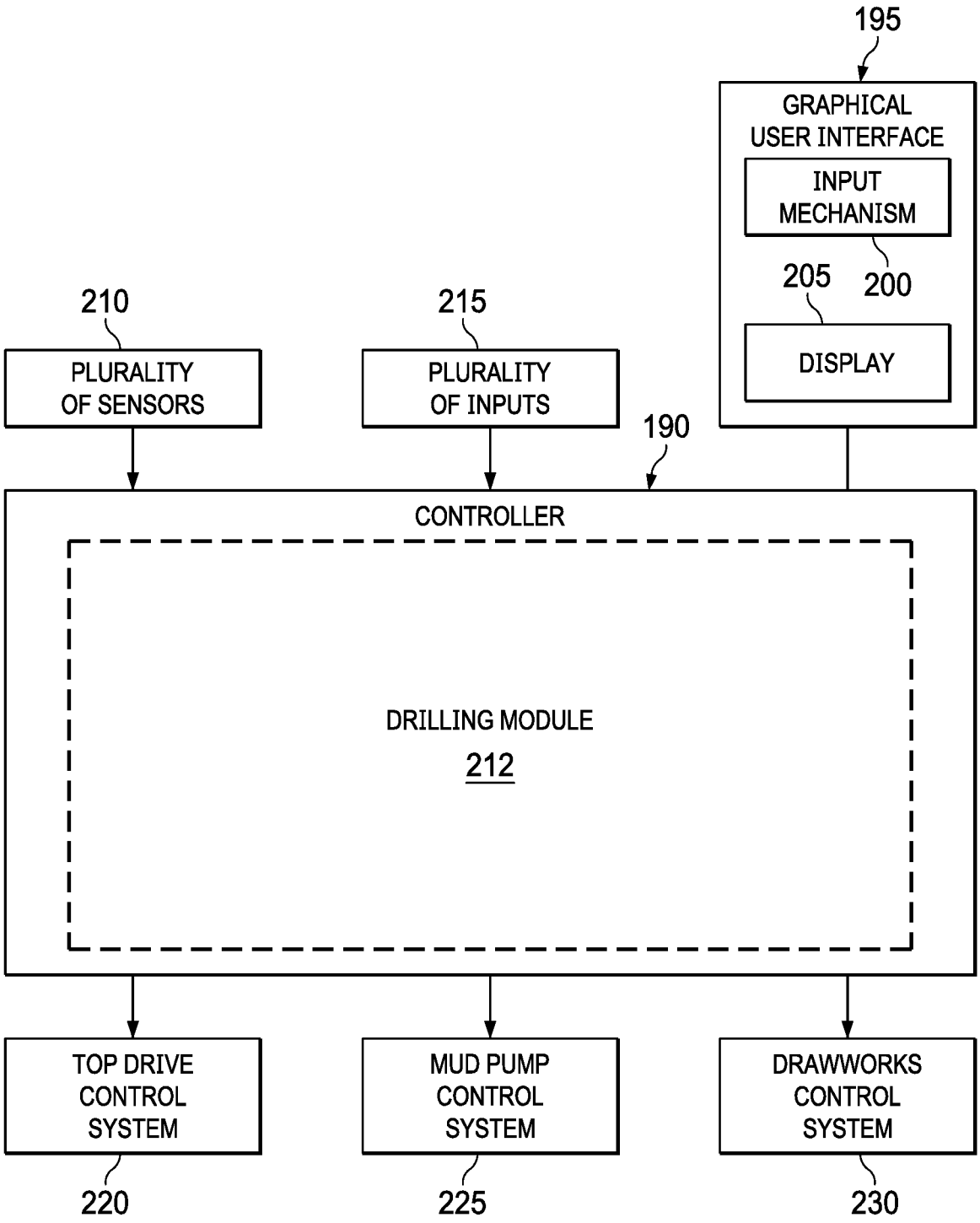
FIG. 2 is a schematic illustration of a portion of the apparatus of FIG. 1, according to one or more aspects of the present disclosure, the apparatus including a graphical user interface ("GUI").
Figure 3:
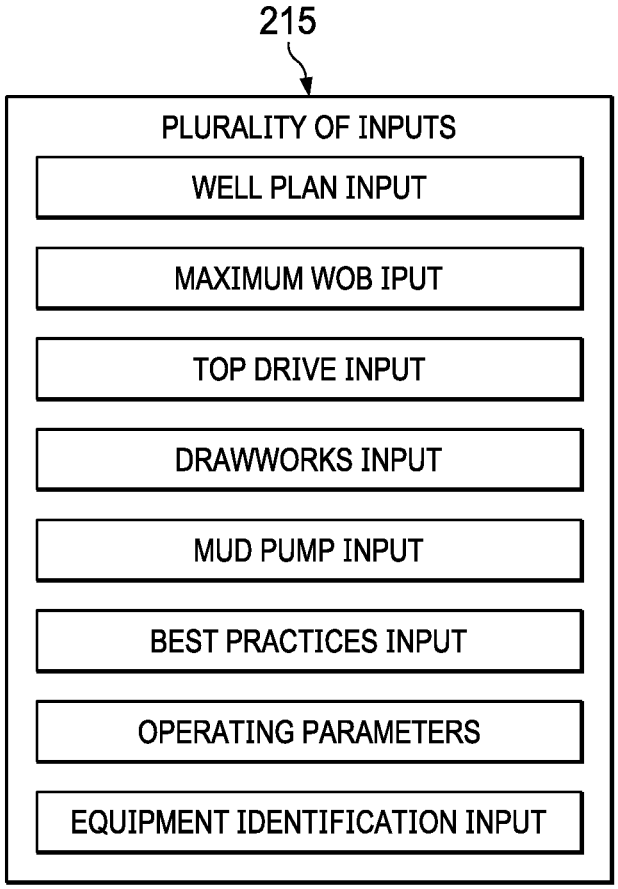
FIG. 3 is a listing of a plurality of inputs used by the drilling rig apparatus of FIG. 1, according to one or more aspects of the present disclosure.

FIG. 2 is a diagrammatic illustration of a data flow involving at least a portion of the apparatus 100 according to one embodiment. Generally, the controller 190 is operably coupled to or includes a GUI 195. The GUI 195 includes an input mechanism 200 for user-inputs or drilling parameters. The input mechanism 200 may include a touch-screen, keypad, voice-recognition apparatus, dial, button, switch, slide selector, toggle, joystick, mouse, data base and/or other conventional or future-developed data input device. Such input mechanism 200 may support data input from local and/or remote locations. Alternatively, or additionally, the input mechanism 200 may include means for user-selection of input parameters, such as predetermined toolface set point values or ranges, such as via one or more drop-down menus, input windows, etc. Drilling parameters may also or alternatively be selected by the controller 190 via the execution of one or more database look-up procedures. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. The display 205 may also be utilized by the user to input the input parameters in conjunction with the input mechanism 200. For example, the input mechanism 200 may be integral to or otherwise communicably coupled with the display 205. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (also not shown in FIG. 1) from a plurality of sensors 210 included in the apparatus 100, where each sensor is configured to detect an operational characteristic or parameter. The controller 190 also includes a drilling module 212 to control a drilling operation. The drilling module 212 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The drilling module 212 generally implements the task of completing a steering operation, which steers the BHA along the planned drilling path; recommends and executes the addition of another stand to the drill string 155; recommends and executes the process of tripping out the BHA 170; among other operations. The controller 190 is also configured to: receive a plurality of inputs 215 from a user via the input mechanism 200; and/or look up a plurality of inputs from a database. In some embodiments and as illustrated in FIG. 3, the plurality of inputs 215 includes the well plan input, a maximum WOB input, a top drive input, a draw works input, a mud pump input, best practices input, operating parameters, and equipment identification input, etc. In some embodiments, the plurality of operating parameters may include a maximum slide distance; a maximum dogleg severity; and a minimum radius of curvature. The plurality of operating parameters also includes orientation-tolerance window ("OTW") parameters, such as an inclination tolerance range and an azimuth tolerance range. The plurality of operating parameters also includes parameters that define an unwanted downhole trend, such as an equipment output trend parameters, geology trend parameters, and other downhole trend parameters. The plurality of operating parameters also includes location-tolerance window ("LTW") parameters, such as an offset direction, an offset distance, geometry, size, and dip angle. In some embodiments, the maximum slide distance may be zero. That is, no slides are recommended while the BHA 170 extends within a first formation type or during a specific period of time relative to the drilling process. The maximum slide distance is not limited to zero feet, but may be any number of feet or distance, such as for example 10 ft., 20 ft., 30 ft., 40 ft. 50 ft., 90 ft., etc. Generally, the maximum dogleg severity is the change in inclination over a distance and measures a build rate on a micro-level (e.g., 3°/100 ft.) while the minimum radius of curvature is associated with a build rate on a macro-level (e.g., 1°/1,000 ft.).

The orientation-tolerance window parameters include an inclination tolerance range and an azimuth tolerance range. In some embodiments, the inclination tolerance range and the azimuth tolerance range are associated with a location along the well plan and change depending upon the location along the well plan. That is, at some points along the well plan the inclination tolerance range and the azimuth tolerance range may be greater than the inclination tolerance range and the azimuth tolerance range along other points along the well plan.

Referring back to FIG. 2, the controller 190 is also operably coupled to a top drive control system 220, a mud pump control system 225, and a draw works control system 230, and is configured to send signals to each of the control systems 220, 225, and 230 to control the operation of the top drive 140, the mud pump 181, and the draw works 130. However, in other embodiments, the controller 190 includes each of the control systems 220, 225, and 230 and thus sends signals to each of the top drive 140, the mud pump 181, and the draw works 130.

In some embodiments, the top drive control system 220 includes the top drive 140, the speed sensor 140*b*, the torque sensor 140*a*, and the hook load sensor 140*c*. The top drive control system 220 is not required to include the top drive 140, but instead may include other drive systems, such as a power swivel, a rotary table, a coiled tubing unit, a downhole motor, and/or a conventional rotary rig, among others.

In some embodiments, the mud pump control system 225 includes a mud pump controller and/or other means for controlling the flow rate and/or pressure of the output of the mud pump 181.

In some embodiments, the draw works control system 230 includes the draw works controller and/or other means for controlling the feed-out and/or feed-in of the drilling line 125. Such control may include rotational control of the draw works (in v. out) to control the height or position of the hook 135 and may also include control of the rate the hook 135 ascends or descends. However, example embodiments within the scope of the present disclosure include those in which the draw works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string.

The plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the mud motor delta pressure sensor; the bit torque sensor 172*b*; the hook position sensor; a rotary RPM sensor; a quill position sensor; a pump pressure sensor; a MSE sensor; a bit depth sensor; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 172*a*, and 172*b* are discussed above and will not be repeated here.

Generally, the rotary RPM sensor is configured to detect the rotary RPM of the drill string 155. This may be measured at the top drive 140 or elsewhere, such as at surface portion of the drill string 155.

Generally, the quill position sensor is configured to detect a value or range of the rotational position of the quill 145, such as relative to true north or another stationary reference.

Generally, the pump pressure sensor is configured to detect the pressure of mud or fluid that powers the BHA 170 at the surface or near the surface.

Generally, the MSE sensor is configured to detect the MSE representing the amount of energy required per unit volume of drilled rock. In some embodiments, the MSE is not directly sensed, but is calculated based on sensed data at the controller 190 or other controller.

Generally, the bit depth sensor detects the depth of the bit 175.

In some embodiments the top drive control system 220 includes the torque sensor 140*a*, the quill position sensor, the hook load sensor 140*c*, the pump pressure sensor, the MSE sensor, and the rotary RPM sensor, and a controller and/or other means for controlling the rotational position, speed and direction of the quill or other drill string component coupled to the drive system (such as the quill 145 shown in FIG. 1). The top drive control system 220 is configured to receive a top drive control signal from the drilling module 212, if not also from other components of the apparatus 100. The top drive control signal directs the position (e.g., azimuth), spin direction, spin rate, and/or oscillation of the quill 145.

In some embodiments, the draw works control system 230 comprises the hook position sensor, the ROP sensor 130*a*, and the draw works controller and/or other means for controlling the length of drilling line 125 to be fed-out and/or fed-in and the speed at which the drilling line 125 is to be fed-out and/or fed-in.

In some embodiments, the mud pump control system 225 comprises the pump pressure sensor and the motor delta pressure sensor 172*a*.

Figure 4:
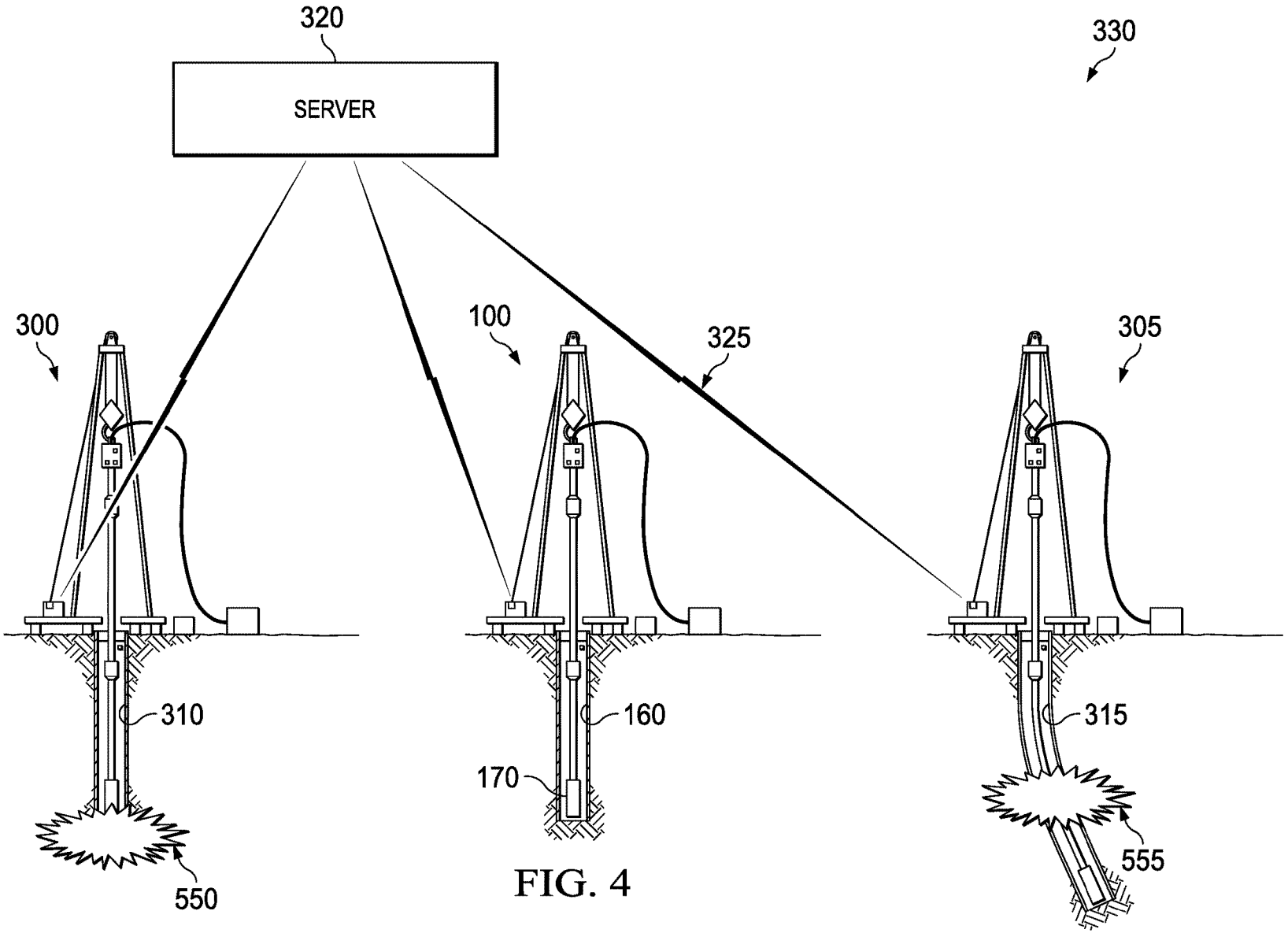
FIG. 4 is a schematic diagram of a network of drilling rigs including the drilling rig apparatus of FIG. 1, according to one or more aspects of the present disclosure.

In some embodiments and as illustrated in FIG. 4, the apparatus 100 is drilling the wellbore 160 in an oilfield in which an apparatus 300 and an apparatus 305 are also drilling or have drilled a wellbore 310 and 315. Each of the apparatus 300 and 305 is generally similar to the apparatus 100 in that each drills a wellbore using a BHA while monitoring downhole and drilling conditions. As illustrated, the apparatus 100, 300, and 305 are connected to a server 320 via a network 325 to form a network of offset drilling rigs 330. In some embodiments, each of the controller 190 of the apparatus 100, a controller of the apparatus 300, and a controller of the apparatus 305 is in communication with the server 320 to send real-time drilling data to the server 320 and receive real-time drilling data from each of the other apparatus 100, 300, and 305. That is, the apparatus 100, 300, and 305 share real-time drilling data within the network of offset drilling rigs 330. In other embodiments, each of the apparatus 100, 300, and 305 sends its respective real-time drilling data to the server 320 and the server 320 determines which portions of the real-time drilling data is to be sent to each of the controllers or apparatus 100, 300, and 305. In some embodiments, a summary of a portion of the real-time drilling data is sent to the apparatus 100, 300, and 305 within the network of offset drilling rigs 330. In some embodiments, the server 320 is remote from each of the apparatus 100, 300, and 305 (e.g., the "cloud"). Regardless, real-time drilling data is shared among the network of offset drilling rigs 330. In some embodiments, the server 320 is located at, or forms a portion of, a remote data center or the "cloud", and receives the data real-time and sends the modified instructions to the apparatus 100.

In an example embodiment, the network 325 includes the Internet, one or more local area networks, one or more wide area networks, one or more cellular networks, one or more wireless networks, one or more voice networks, one or more data networks, one or more communication systems, and/or any combination thereof.

Figure 5:
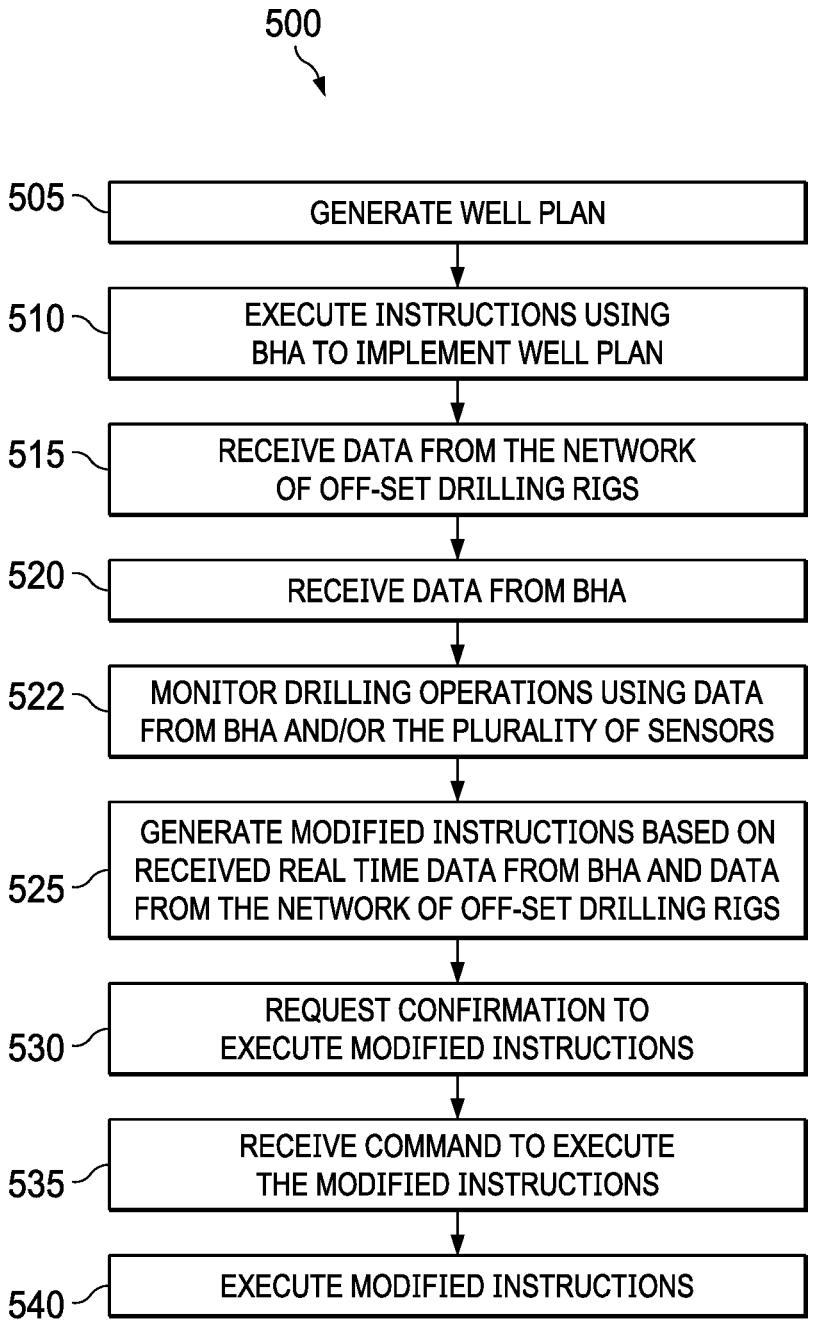
FIG. 5 is a flow-chart diagram of a method according to one or more aspects of the present disclosure.

In an example embodiment, as illustrated in FIG. 5 with continuing reference to FIGS. 1-4, a method 500 of operating the apparatus 100 includes generating a well plan at step 505; executing instructions using the BHA 170 to implement the well plan at step 510; receiving data from the network of offset drilling rigs 330 at step 515; receiving real-time data from the BHA 170 at step 520; monitoring drilling operations at step 522; generating modified instructions based on the received real-time data from the BHA 170 and the data from the network of offset drilling rigs 330 at step 525; requesting confirmation to execute the modified instructions at step 530; receiving a command to execute the modified instructions at step 435; and executing the modified instructions at step 540.

At the step 505, a well plan is generated. Generally, the well program is stored or accessible to the controller 190 so that the controller 190 is capable of comparing the current well path or well path trajectory with the planned or ideal well path. In some embodiments, the well plan for the wellbore 160 is generated based on a variety of factors. For example, the well plan can be based on historical data related to: the drilling operation of wellbores within the network of offset drilling rigs 330 such as wellbores 310 and 315; the drilling operation of any wellbore; drilling operations using the specific type of equipment used in the drilling operation of the wellbore 160; the type of expected formation and related pressure associated with the type of formation; among others. The historical data may be identical to the expected drilling conditions for the wellbore 160, or it may relate to drilling conditions and data that are only substantially the same as the current situation. As used herein, the term "substantially the same" can be understood to mean similar historical conditions likely to lead to the same result in the present, e.g., based on a similar geologic formation and the same drilling conditions or the same geologic formation and similar drilling conditions, or the like. In the event the above wording is insufficiently precise, the term "substantially the same" could also be understood herein to mean current numerical values that are up to about ten percent (10%) above or below the historical data, or historical data which are up to about ten percent (10%) above or below the current condition. Regardless, the well plan generally includes a target location and an optimal wellbore profile or planned path to the target location. Such well plans are generally based upon the most efficient or effective path to the target location or locations. Using the planned path, drilling instructions are generated. These drilling instructions are referenced by the drilling module 212 and the drilling operator when the wellbore 160 is drilled. In some embodiments, the well plan is generated days or weeks prior to the wellbore 160 being drilled, which allows for the equipment required for the well plan (e.g., casing, mud pumps, mud, etc.) to be delivered to the apparatus 100. In some embodiments, the well plan is generated prior to the drilling of the wellbores 310 and 315, and thus, does not account for data acquired during the drilling of the wellbores 310 and 315. Generally, the well plan is based on a predicted motor output, which represents the theoretical "build" that the motor placed in the BHA 170 will create during a slide.

Figure 6:
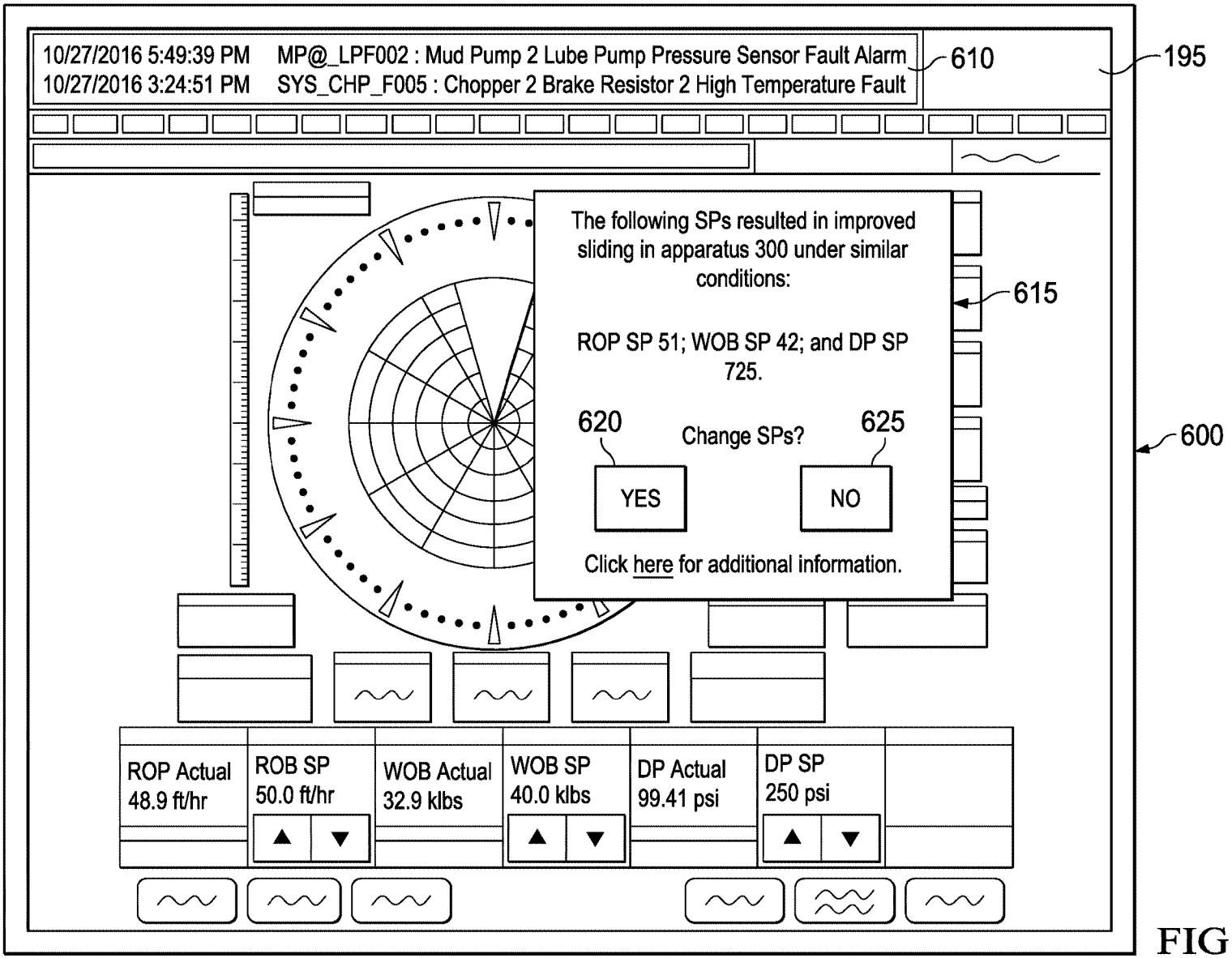
FIG. 6 is a screen that is displayed on the GUI of FIG. 2, according to one or more aspects of the present disclosure.

At the step 510, at least a portion of the drilling instructions are executed. Generally, the drilling instructions are instructions related to any drilling operation, including the length and direction of a slide, the timing for tripping out the BHA 170, the target WOB, the target rate of penetration ("ROP"), the target number of wraps in each direction during oscillation of the drill string 155, etc. That is, the drilling instructions are not limited to instructions to drill, but also include instructions for activities before and after drilling. As illustrated in FIG. 6, drilling instructions are displayed and received via a screen 600 that is displayed on the GUI 195. As illustrated, the drilling instructions are at least partially displayed as set points, such as a ROP set point ("SP"), WOB SP, and DP SP. Moreover, the drilling instructions relating to the target drilling direction are displayed as a target direction shown on a dial 605, or target shape having a plurality of concentric nested rings to represent the drilling direction of the BHA 170, on the screen 600. In some embodiments, the drilling operator monitors the drilling operation via a visual comparison between the target SPs and actual measurements displayed on the screen 600. Generally, the actual measurements are generated by the plurality of sensors 210. In some embodiments, the drilling module 212 and/or the controller 190 monitors the difference and displays a text box 610 or other notice providing updates regarding the drilling operation based on the difference. In some embodiments, the text box 610 includes warning, alerts, etc. relating to the drilling operation. That is, the drilling module 212 monitors the drilling operations via the plurality of sensors 210 and compares the drilling operations to the target path and the plurality of inputs 215 (e.g., the best practices input, the maximum WOB input, the operating parameters). Using the screen 600, executing the instructions includes the drilling module 212 controlling the top drive control system 220, the mud pump control system 225, and the drawworks control system 230 to perform a variety of drilling operations. The variety of drilling operations includes tripping out the BHA 170, taking the BHA 170 off bottom to release torque from the drill string 155, setting the BHA 170 on bottom and aligning the drill face to begin a slide, sliding, vertical drilling (e.g., drilling while not sliding), etc.

At the step 515, data is received from the network of offset drilling rigs 330. In some embodiments, the data is received by the controller 190 via the server 320 but in other embodiments the data is received by the server 320 and the controller 190 accesses the data from the server 320. Regardless, the controller 190 and the drilling module 212 have access to real-time data generated by the apparatus 300 and/or 305. In some embodiments and referring back to FIG. 4, the real-time data received from the apparatus 300 includes data relating to a drilling event 550 that occurred during the drilling of the wellbore 310, and the real-time data received from the apparatus 305 includes data relating to a drilling event 555 during the drilling of the wellbore 315. The drilling events 550 and 555 can be a variety of drilling events, including a drilling anomaly, a predicted drilling anomaly, tripping out of the BHA, etc. Generally, the real-time data from the network of offset drilling rigs 330 includes formation data regarding the formation through which the wellbores 310 and 315 extend, equipment data regarding the type of equipment used to form the wellbores 310 and 315, drilling operations performed during the drilling of the wellbores 310 and 315, drilling operations proposed but not performed during the drilling of the wellbores 310 and 315, location data regarding the BHA, data relating to a comparison between the actual wellplan and target well plan including drift, etc. In some embodiments, the data includes a trend identified by the controller of the apparatus 300 and/or 305, a proposed modified instruction in response to the trend, the action taken (e.g., acceptance of proposed modification or rejection of the proposed modification), and the result of the action taken (e.g., correction/reversal of trend, no affect to trend, and magnification of trend). In some embodiments, the real-time data is received from the network of offset drilling rigs 330 after at least a portion of the instructions are executed in the step 415.

At the step 520, data is received from the BHA 170. In some embodiments, data includes survey data gathered via the plurality of sensors 210 and/or continuous data gathered via the plurality of sensors 210 between two consecutive surveys. In some embodiments, the steps 515 and 520 occur simultaneously.

At the step 522, the drilling module 212 monitors drilling operations using the data from the BHA 170 and/or the plurality of sensors 201. In some embodiments, the drilling module 212 identifies a trend, which may include any one or more of an equipment output trend; a formation/geology related trend; and other downhole trends based on the data. An example of an equipment output trend includes, for example, a motor output trend, or other trend relating to the operation of a piece of equipment. An example of the formation related trend may include, for example, a trend relating to pore pressure. An example of other downhole trends is a downhole parameter trend, such as for example a trend relating to differential pressure. Another example of the other downhole trends is a BHA location and/or orientation trend. An example of the BHA location and/or orientation trend may include a trend that the location of the BHA 170 is inching closer to an edge or boundary of the LTW or the OTW. In some embodiments and when the drilling conditions or data received from the sensors 210 exceeds or falls below a predetermined threshold, fits a predetermined pattern, or otherwise is classified as a drilling anomaly, the apparatus 100 displays an alert to alert the user of the detected drilling anomaly. The alert identifies the detected drilling anomaly. A drilling anomaly may include a potential anomaly, which is a situation in which the drilling conditions and data received is trending towards a drilling anomaly, and a detected anomaly, which is a situation in which the drilling conditions and data have been classified as a drilling anomaly. In some embodiments, the drilling anomaly includes any one or more of a stick-slip event; a predicted stick-slip event; a kick detection; a predicted kick event; a high inflow detection; a predicted high inflow event; a deviation from a well plan; or a predicted deviation from the well plan. Generally, the drilling anomaly is an undesired event that hinders or could hinder the optimum performance of drilling operations. For example, a drilling anomaly includes: a slower ROP being detected when the optimum ROP being prescribed is much higher; an anomaly being detected downhole which can cause a mud motor stall or bit wear that would result in an unplanned trip out thereby increasing the non-productive time spent on the well; and/or slower trip speeds being detected that can also contribute to the increase in non-productive time spent on the well. Another example includes a drilling anomaly of a slower ROP being detected when the optimum ROP being prescribed is much higher.

At the step 525, modified instructions are generated based on the received real-time data from the BHA 170 and data from the network of offset drilling rigs 330. Generally, the drilling module 212 automatically generates modified instructions to address any detected or potential anomaly associated with the wellbore 160. For example, when the BHA 170 is drilling without sliding, then the drilling module 212 generates modified instructions that update the set points of the ROP, WOB, increase or decrease the mud motor delta pressure, initiate the addition of a new stand, among other tasks. When the BHA 170 is sliding, then the drilling module 212 generates modified instructions that update the target oscillation parameters (e.g., wraps of the drill pipe in one direction and another) to maintain toolface position and/or change toolface position, increase or decrease slide target distance, increase or decrease the mud motor delta pressure, increase or decrease WOB, etc. In some embodiments, the drilling module 212 compares a motor output associated with a BHA from the network of offset drilling rigs 330 to an actual motor output of the BHA 170 and the modified instructions is based on the comparison. In some embodiments, the drilling module 212 compares the predicted motor output associated with the well plan and/or drilling instruction to an actual motor output of the BHA 170 and the modified instructions is based on the comparison. In some embodiments and when generating the modified instructions, the drilling module 212 considers a historical success rate based on historical data related to: the drilling operation of the wellbore 160; the drilling operations of the network of offset drilling rigs 330 using the real-time data received at the step 515; the drilling operation of any wellbore; drilling operations using the specific type of equipment used in the drilling operation of the wellbore 160; and/or the user's success rate, etc. The historical data may be identical to the current drilling conditions, or it may relate to drilling conditions and data that are only substantially the same as the current situation. As used herein, the term "substantially the same" can be understood to mean similar historical conditions likely to lead to the same result in the present, e.g., based on a similar geologic formation and the same drilling conditions or the same geologic formation and similar drilling conditions, or the like. In the event the above wording is insufficiently precise, the term "substantially the same" could also be understood herein to mean current numerical values that are up to about ten percent (10%) above or below the historical data, or historical data which are up to about ten percent (10%) above or below the current condition. Again referring to FIG. 6, the drilling module 212 reviews the data received from the network of offset drilling rigs 330 and compares the conditions to the conditions associated with the wellbore 160. The drilling module 212 determines that slides using the apparatus 300 were improved, under similar conditions, using the following parameters: ROP SP 51; WOB SP 42: and DP SP 725. The drilling module 212 also identifies that the current parameters are set, as illustrated in FIG. 6, at ROP SP 50, WOB SP 40; and DP SP 750. Thus, the current parameters or instructions are not the ideal parameters or instructions. In this situation, the drilling module 212 generates modified instructions of ROP SP 51; WOB SP 42: and DP SP 725. In some embodiments, the drilling module 212 adjusts or calibrates for differences in drilling conditions experienced by the apparatus 100, 300, and 305.

At the step 530, the drilling module 212 requests confirmation to execute the modified instructions. In some embodiments and as illustrated in FIG. 6, a message 615 is displayed over the screen 600. However, the message 615 can be displayed anywhere on the GUI 195 or can include an audible message, etc. The message 615 includes the modified instructions and a request to execute the modified instructions. As illustrated, the message 615 regards a drilling event (e.g., a slide) and information potentially related to the drilling event that is based on the apparatus 300 and/or the apparatus 305. For example, the message 615 includes a message of "The following SPs resulted in improved sliding in apparatus 300 under similar conditions: ROP SP 51; WOB SP 42: and DP SP 725." The message 615 also requests confirmation to execute the modified instructions via "Change SPs" and a selectable yes button 620 and a selectable no button 625. The message 615 itself is selectable, and the drilling operator can select the message 615 to view additional information regarding the drilling operation associated with the apparatus 300.

At the step 535, a command to execute one of the proposed actions is received by the apparatus 100 via the GUI 195. In some embodiments, the drilling operator selects either the button 620 or the button 625. The selection of the button 620 or 625 results in the apparatus 100 receiving the command. However, in other embodiments, the command is received via a microphone, keyboard, etc.

At the step 540, the apparatus 100 executes the modified instructions in response to the receipt of the command to execute the modified instructions. In some embodiments, selecting the selectable yes button 620 automatically updates the instructions. That is, the set points are automatically updated. In some embodiments, the drilling module 212, along with the top drive controller system 220, the mud pump control system 225, and the draw works control system 230 automatically execute the modified instructions without, or with very little, user interaction. When the proposed modified instructions include a workflow, the receipt of the command to execute the instructions initiates a workflow associated with the proposed modified instructions that is automatically executed by the apparatus 100. In other embodiments, additional screens are presented to the user to guide the user in the execution of the modified instructions. That is, the apparatus 100 guides the user through the workflow for the user to approve of each sub step of the workflow.

Figure 7:
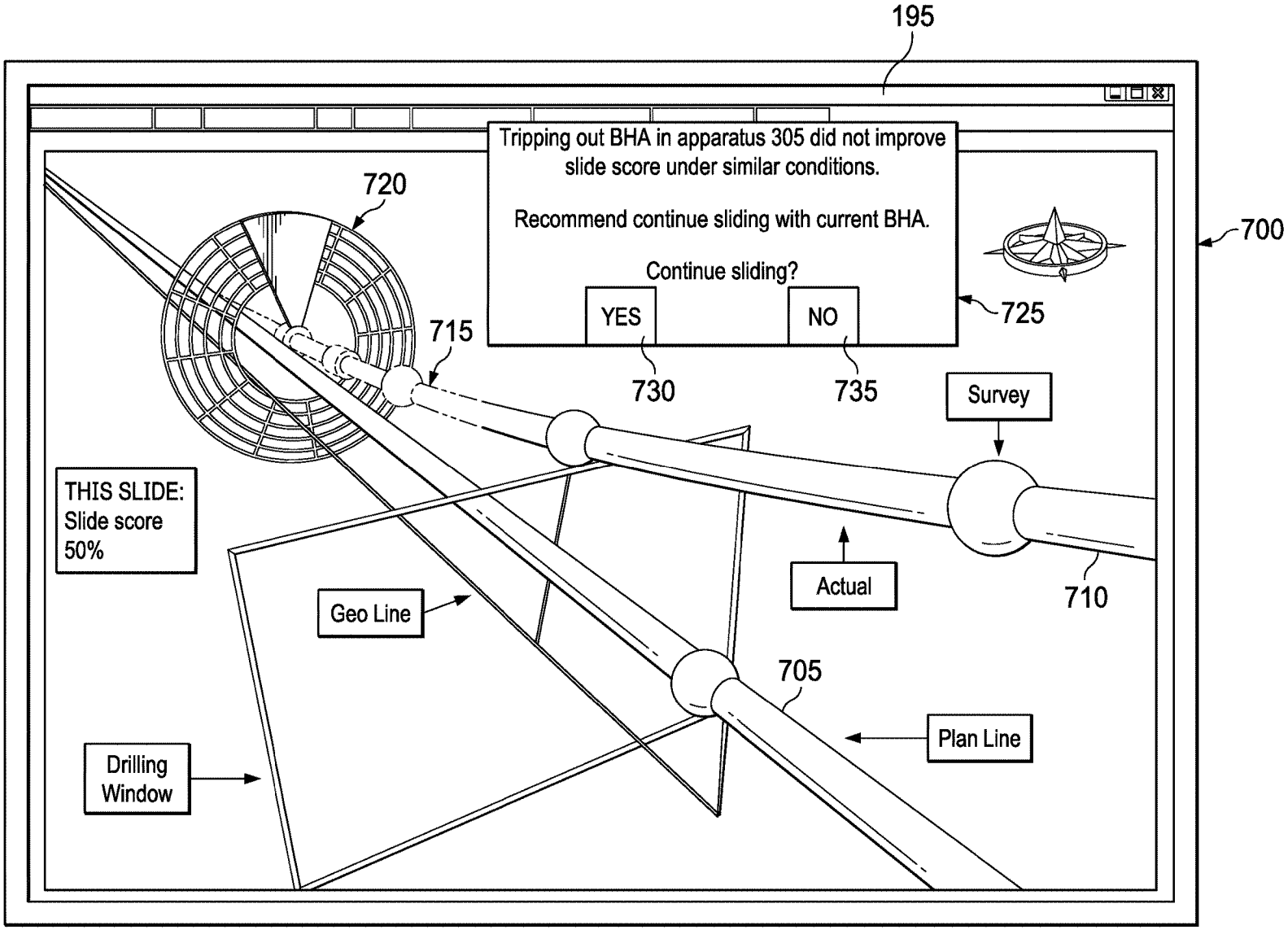
FIG. 7 is another screen that is displayed on the GUI of FIG. 2, according to one or more aspects of the present disclosure.

The method 500 can be altered in a variety of ways. For example, the drilling module 212 can provide feedback regarding instructions received from the drilling operator. That is, the drilling module 212 can propose modification to computer-generated instructions and instructions received from the user or drilling operator. FIG. 7 illustrates a screen 700 that includes a three-dimension view of a target plan line 705 compared to a three-dimensional view of the actual well path 710 of the wellbore 160. Generally, the three-dimension view of the actual well path 710 is generated based on data received from the plurality of sensors 210. As illustrated, the target plan line 705 does not align with the actual well path 710. The screen 700 also includes a three-dimension view of a projected, future well path 715 and a dial 720 or target shape having a plurality of concentric nested rings to represent the drilling direction of the BHA 170. After reviewing the screen 700, the drilling operator may determine, in response to an unexpected build rate or slide score, that the bit 175 should be replaced. In that case, the drilling operator may provide instructions to the drilling module 212 to begin tripping out the BHA 170. The instructions may include an instruction to lift the bit 175 off the bottom, etc. Before, during, or after receiving the instruction from the drilling operator to initiate tripping out the BHA 170, the drilling module 212 may determine, based on the real-time data associated with the network of offset drilling rigs 330, that tripping out of the BHA of the apparatus 305 under a similar situation did not improve the slide score or build rate. Thus, based on the real-time data associated with the network of offset drilling rigs 330, the drilling module 212 displays a message 725 includes a message of "Tripping out BHA in apparatus 305 did not improve slide score under similar conditions." The message 725 also requests confirmation to execute the modified instructions via selectable yes button 730 and a selectable no button 735, with the modified instructions being instructions that are different from the instructions received from the drilling operator. Thus, the modified instructions generated by the drilling module 212 are not limited to instructions that are different from the well plan, but include any modification to an instruction received via the GUI 195 or otherwise.

In some embodiments, the modified instructions are instructions that are different from historical instructions received from the drilling operator. That is, the modified instructions are different from instructions not yet received by the drilling module 212 but are predicted to be received by the drilling module 212. For example, the drilling module 212 predicts, based on historical data associated with the drilling operator, that the drilling operator will trip out the BHA 170 in response to the target plan line 710 not aligning with the actual well path. In that case, the predicted trip out is a potential drilling event and the drilling module 212 evaluates the potential drilling event considering the real-time data provided by the network of offset drilling rigs 330 and provides modified instructions relative to the potential drilling event. That is, historical data associated with the drilling operator indicates that the drilling operator has tripped out the BHA 170 (or similar BHA) in 90% of historical situations similar to the current situation. The drilling operator of the apparatus 305 also tripped out the BHA in response to a similar situation, but the slide score did not improve. Thus, using the real-time data received from the network of offset drilling rigs 330, the real-time data received from the BHA 170, and historical data relating to the drilling operator, the drilling module 212 provides the message 725. Thus, in response to a first drilling event (e.g., failure to improve build rate after tripping out BHA at apparatus 305), the drilling module 212 generates modified instructions to delay or avoid a second drilling event (e.g., failure to improve build rate after tripping out BHA 170 at apparatus 100) that is identical to the first drilling event.

Figure 8:
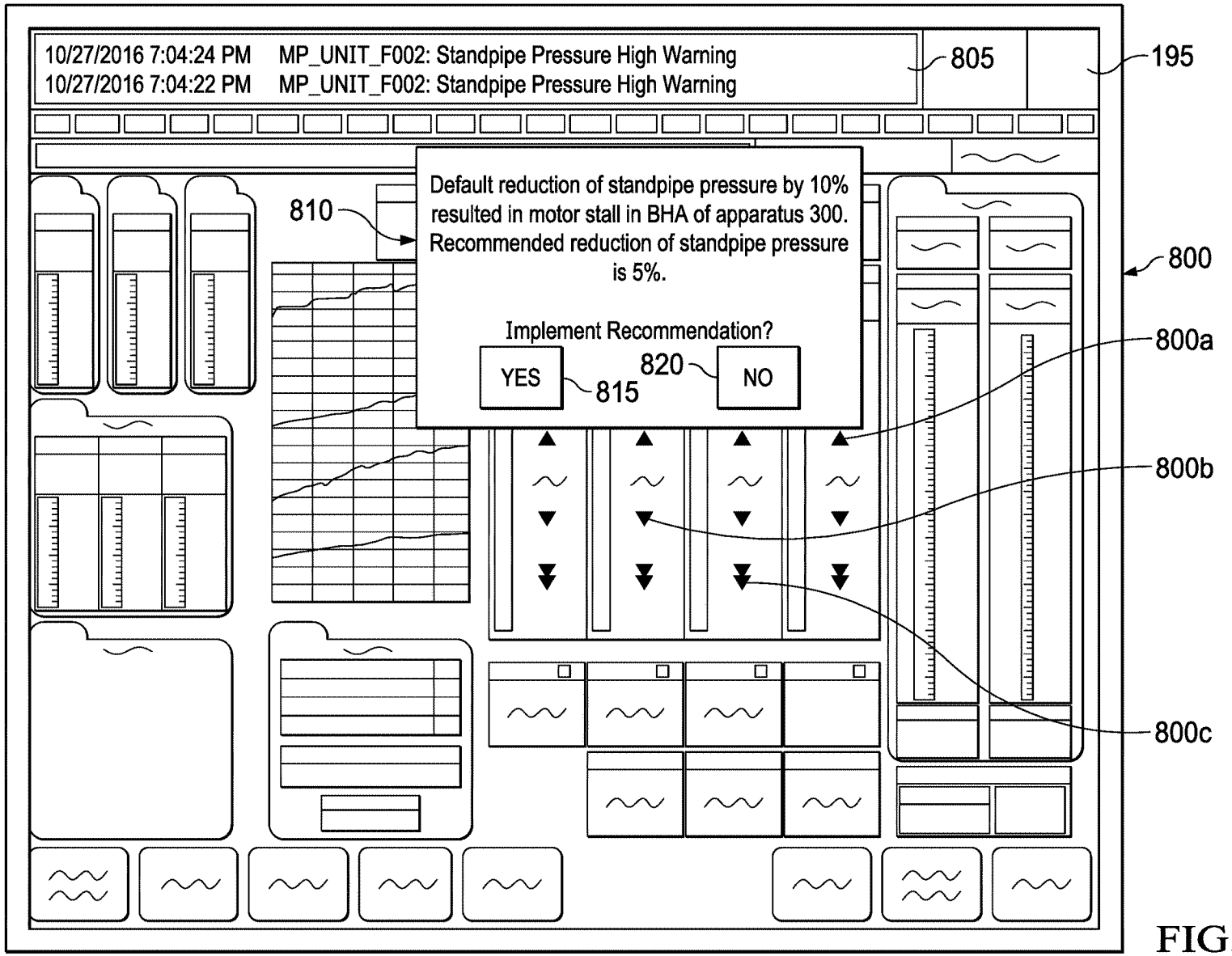
FIG. 8 is another screen that is displayed on the GUI of FIG. 2, according to one or more aspects of the present disclosure.

Another variation to the method 500 is illustrated in FIG. 8. FIG. 8 illustrates a screen 800 that includes data relating to the ROP, WOB, DP, and Torque, among other parameters associated with drilling mode. The screen 800 includes selectable buttons 800*a*, 800*b*, 800*c*, etc. that receive instructions or modifications to the drilling instructions. An alert 805 is displayed indicating that the standpipe pressure is high. As illustrated, the drilling module 212, using the real-time data received by the BHA 170, determines that the standpipe pressure is high. In response to high standpipe pressure, the default mitigation activity is to reduce the standpipe pressure by 10%. The drilling module 212, based on the real-time data received by the network of offset drilling rigs 330, determines that in a similar situation, the standpipe pressure was reduced by the default 10% and the motor stalled at the apparatus 300. Thus, the drilling module 212 displays a message 810 that provides a recommendation, requests confirmation to implement the recommendation, and provides details regarding why the recommendation is being made. Specifically, the message 810 states "Default reduction of standpipe pressure by 10% resulted in motor stall in BHA of apparatus 300. Recommended reduction of standpipe pressure is 5%. Implement Recommendation?" The user can select a yes selectable button 815 or a no selectable button 820. Therefore, when the a BHA was tripped out in response to a first drilling event (e.g., over-reduction of standpipe pressure resulting in motor stall), the drilling module 212 generates modified instructions to delay or avoid a second drilling event (e.g., overreduction of standpipe pressure resulting in motor stall) that is identical to the first drilling event to avoid tripping out the BHA 170.

In some embodiments, the steps 510, 515, 520, 522, 525, 530, and 535 occur during the drilling of one stand of pipe. In some embodiments, the steps 510, 515, 520, 522, 525, 530, and 535 occur between a first and second consecutive standard static survey. Conventionally, a standard static survey is conducted at each drill pipe connection to obtain an accurate measurement of inclination and azimuth for the new survey position, while continuous data is data received from the BHA 170 between standard static surveys. As such, the apparatus 100 can monitor a slide as the slide progresses without having to wait for the next standard static survey. Moreover, the apparatus 100 can alter instructions regarding the slide in response to the progress of the slide and in response to data received by the network of offset drilling rigs 330. In some embodiments, the steps 510, 515, 520, 522, 525, 530, and 535 occur after a first stand of drill pipe is added to the drill string 155 and before a second consecutive stand of drill pipe is coupled to the drill string 155. In some embodiments, the data received from the network of offset drilling rigs 330 occurs in real-time. That is, the data received by the network of offset drilling rigs 330 is shared without significant delay once received at the surface. For example, in some embodiments there is a delay between when data is gathered—at the BHA or other downhole tools associated with the apparatus 300 and 305—and when the data is received at the surface of the apparatus 300 and 305. Once received at the surface of the apparatus 300 and 305, the data is shared in real-time with the server 320. In other words, real-time indicates sharing of data between controllers located at the surface of the apparatus 100, 300, and 305 within minutes and/or seconds.

In some embodiments, the step 430 is omitted and the apparatus 100 automatically executes the modified instructions without confirmation from the drilling operator. In other embodiments, the apparatus 100 requests confirmation to execute the modified instructions when the modified instructions do not comply with the plurality of inputs 215. For example, the plurality of inputs includes a maximum slide distance and the modified instructions recommend a slide distance that exceeds the maximum slide distance. Due to the modified instructions not complying with the maximum slide distance, the drilling module 212 requests confirmation to execute the modified instructions.

In some embodiments, the drilling module 212 optimizes the instructions executed during the step 510 using drilling data received from the BHA 170 and/or the plurality of sensors 210. For example, the instructions executed during the step 510 have been modified based on continuous data received by the BHA 170 during a slide drilling event. That is, the drilling module 212 uses the data received via the BHA 170 during a slide, or other drilling event, to optimize and change the drilling instructions thereby forming a closed loop system. Using the method 500, the closed loop system considers data from the network of offset drilling rigs 330 to further optimize instructions and a plan of action.

Using the apparatus 100 and/or the method 500, data is shared within the network of offset drilling rigs 330 in real-time so that the apparatus 100 determines whether the instructions currently being followed are optimal. When the instructions being followed are not optimal, the drilling module 212 generated modified instructions. That is, the apparatus 100 and/or the method 500 optimizes the instructions, which reduces the frequency of or duration of sliding. As sliding can increase the wellbore tortuosity, which impacts production yield and casing operations, reducing the frequency and/or duration of slides decreases wellbore tortuosity and improves production yield.

In some embodiments, the use of the apparatus 100 and/or implementation of the method 500 removes or reduces the number of subjective decisions, which are made by the user or drilling operator when the user relies on their muscle memory and previous experiences in order to detect and react to a drilling anomaly. In some embodiments, the apparatus 100 and/or implementation of the method 500 reduces the time required to react to a drilling anomaly, detect a predicted drilling event or anomaly, present options to mitigate the anomaly, and execute the option. Quickly response often prevents equipment failure and/or well control issues.

Thus, the method 500 and/or the apparatus 100 involves or is an improved user interface for computing devices at least in part due to the particular manner of summarizing and presenting information on the GUI 195. The screens 600, 700, and 800 list a limited set of data and restrains the type of data that can be displayed. Displaying the buttons to automatically adopt and implement a recommendation action results in drilling anomalies being quickly resolved, which reduces the likelihood or frequency of equipment failure and/or well control issues.

In some embodiments, while executing a first portion of the well plan and based on the execution performance and the information gathered from the network of offset drilling rigs 330, the apparatus 100 makes recommendations to the user about the performance and the impacts so as to make the user take measures proactively to avoid any undesired event.

Methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 of an integer, within the range.

Figure 9:
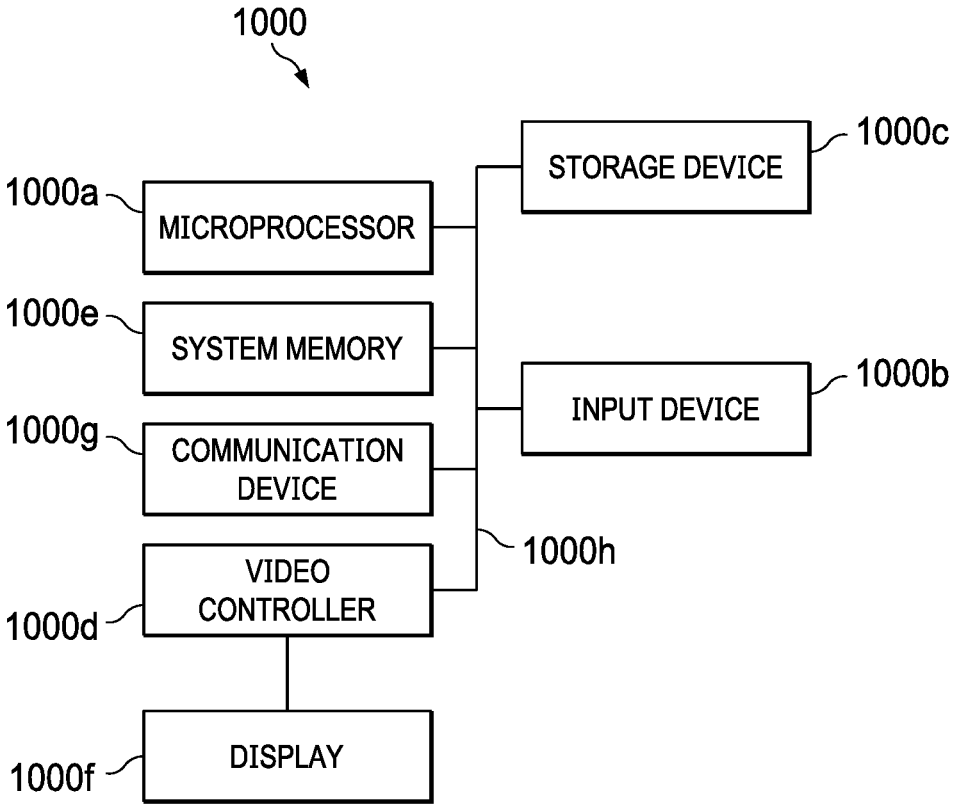
FIG. 9 is a diagrammatic illustration of a node for implementing one or more example embodiments of the present disclosure, according to an example embodiment.

In an example embodiment, as illustrated in FIG. 9 with continuing reference to FIGS. 1-8, an illustrative node 1000 for implementing one or more embodiments of one or more of the above-described networks, elements, methods and/or steps, and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g*, all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable non-transitory medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, and cell phones.

In several example embodiments, one or more of the controllers 180, 190 the GUI 195, and any of the sensors, includes the node 1000 and/or components thereof, and/or one or more nodes that are substantially similar to the node 1000 and/or components thereof.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, a database may be any standard or proprietary database software, such as Oracle, Microsoft Access, SyBase, or DBase II, for example. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted or rearranged. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of drilling a first wellbore in an oilfield in which an offset wellbore has been formed, which method comprises:

executing, using a computing system, at least a portion of a first set of instructions based on a well plan for the first wellbore using a first bottom hole assembly (BHA);

receiving, by the computing system, drilling data from the first BHA;

identifying, by the computing system, a first drilling event associated with the drilling data from the first BHA;

receiving, by the computing system and from a user, a first user-input response to the first drilling event;

receiving, by the computing system, after the execution of at least the portion of the first set of instructions, offset drilling data associated with the drilling of the offset wellbore;

wherein the offset drilling data comprises:

drilling data associated with a second drilling event that occurred during the drilling of the offset wellbore;

wherein the second drilling event is identical to the first drilling event;

a second user-input response to the second drilling event;

wherein the second user-input response is identical to the first user-input response; and results associated with the implementation of the second user-input response;

determining, by the computing system, that the results associated with the implementation of the second user-input response did not resolve the second drilling event;

displaying, to the user via the computing system, a message that the second user-input response did not resolve the second drilling event;

generating, using the computing system, a second set of instructions based on the offset drilling data;

wherein the second set of instructions is based on the well plan for the first wellbore and the drilling data from the first BHA; and wherein the second set of instructions is different from the first user-input response;

requesting confirmation to execute the second set of instructions; and executing the second set of instructions after receipt of confirmation to execute the second set of instructions.

2. The method of claim 1, wherein the first BHA comprises a first motor;

wherein the drilling data from the first BHA comprises a first motor output;

wherein the offset drilling data comprises a second motor output associated with a second BHA drilling the offset wellbore;

wherein the method further comprises comparing, using the computing system, the first motor output to the second motor output; and wherein generating the second set of instructions is further based on the comparison of the first motor output to the second motor output.

3. The method of claim 1, wherein the offset drilling data further comprises data associated with tripping out a second BHA that extended within the offset wellbore in response to the second drilling event; and wherein the second set of instructions is generated to delay or avoid tripping out the first BHA in response to the first drilling event.

4. The method of claim 1, wherein executing at least a portion of the first set of instructions, receiving the offset drilling data, generating the second set of instructions, requesting confirmation to execute the second set of instructions, and executing the second set of instructions occur after a first stand of drill pipe is coupled to the first BHA and before a second consecutive stand of drill pipe is coupled to the first BHA.

5. The method of claim 1, wherein receiving the offset drilling data occurs in real-time.

6. An apparatus for drilling a first wellbore in an oilfield in which an offset wellbore has been formed comprising:

a user interface; and a controller communicatively connected to a first bottom hole assembly ("BHA") and configured to:

execute, using the first BHA, at least a portion of a first set of instructions based on a well plan relating to the first wellbore;

receive data from the first BHA;

identify a first drilling event associated with the data from the first BHA;

receiving, from a user, a first user-input response to the first drilling event;

receive, after the execution of at least the portion of the first set of instructions, offset drilling data associated with the drilling of the offset wellbore;

wherein the offset drilling data comprises:

drilling data associated with a second drilling event that occurred during the drilling of the offset wellbore;

wherein the second drilling event is identical to the first drilling event;

a second user-input response to the second drilling event;

wherein the second user-input response is identical to the first user-input response; and results associated with the implementation of the second user-input response;

determine that the results associated with the implementation of the second user-input response did not resolve the second drilling event;

display, to the user, a message that the second user-input response did not resolve the second drilling event;

generate a second set of instructions based on the offset drilling data;

wherein the second set of instructions is based on the well plan relating to the first wellbore and the data from the first BHA; and wherein the second set of instructions is different from the first user-input response;

request, using the user interface, confirmation to execute the second set of instructions; and execute, using the first BHA, the second set of instructions after receipt of confirmation to execute the second set of instructions.

7. The apparatus of claim 6, wherein the first BHA comprises a first motor;

wherein the drilling data from the first BHA comprises a first motor output;

wherein the offset drilling data comprises a second motor output associated with a second BHA drilling the offset wellbore;

wherein the controller is further configured to compare the first motor output to the second motor output; and wherein the controller is configured to generate the second set of instructions based on the comparison of the first motor output to the second motor output.

8. The apparatus of claim 6, wherein the offset drilling data further comprises data associated with tripping out a second BHA that extended within the offset wellbore in response to the second drilling event; and wherein the second set of instructions is generated to delay or avoid tripping out the first BHA in response to the first drilling event.

9. The apparatus of claim 6, wherein the controller is further configured to, after a first stand of drill pipe is coupled to the first BHA and before a second consecutive stand of drill pipe is coupled to the first BHA, execute at least a portion of the first set of instructions, receive the offset drilling data, calculate the second set of instructions, request confirmation to execute the second set of instructions, and execute the second set of instructions.

10. The apparatus of claim 6, wherein the controller is further configured to receive the offset drilling data in real-time.

* * * * *